US007318523B2

(12) United States Patent
Spatafora

(10) Patent No.: US 7,318,523 B2
(45) Date of Patent: Jan. 15, 2008

(54) RIGID CONTAINER FOR TOBACCO ITEMS AND METHOD OF PRODUCING SUCH A CONTAINER

(75) Inventor: Mario Spatafora, Granarolo (IT)

(73) Assignee: G.D Societa' per Azioni, Bologna (IT)

( * ) Notice: Subject to any disclaimer, the term of this patent is extended or adjusted under 35 U.S.C. 154(b) by 493 days.

(21) Appl. No.: 10/508,725

(22) PCT Filed: Mar. 21, 2003

(86) PCT No.: PCT/EP03/50075

§ 371 (c)(1),
(2), (4) Date: Sep. 17, 2004

(87) PCT Pub. No.: WO03/080474

PCT Pub. Date: Oct. 2, 2003

(65) Prior Publication Data

US 2005/0121340 A1 Jun. 9, 2005

(30) Foreign Application Priority Data

Mar. 21, 2002 (IT) ..... BO2002A0138

(51) Int. Cl.
*B65D 85/10* (2006.01)

(52) U.S. Cl. ..... 206/268; 206/271; 53/228; 53/456

(58) Field of Classification Search ..... 206/265, 206/268, 271, 273; 229/160.1; 53/228, 53/456

See application file for complete search history.

(56) References Cited

U.S. PATENT DOCUMENTS 2,169,382 A 8/1939 Di Domenico et al.
5,143,282 A * 9/1992 Pham ..... 229/160.1
5,833,060 A * 11/1998 Draghetti et al. ..... 206/268
5,904,244 A 5/1999 Focke et al.
2004/0055909 A1* 3/2004 Gamberi et al. ..... 206/271

FOREIGN PATENT DOCUMENTS

| | | |
|---|---|---|
| DE | 31 16924 | 2/1983 |
| DE | 196 02 192 | 7/1997 |
| DE | 201 01 554 | 3/2001 |
| DE | 100 47 447 | 5/2001 |
| EP | 0 764 595 | 3/1997 |

* cited by examiner

*Primary Examiner*—David T. Fidei
(74) *Attorney, Agent, or Firm*—Marshall, Gerstein & Borun LLP

(57) ABSTRACT

A rigid container for tobacco items, defined by a tubular lateral wall (11) and by at least one end wall (6), and wherein one of the two walls (6, 11) has at least one inwardly concave portion (13; 82; 91; 96; 102; 113), and the other wall has at least one flat portion (8; 114), which mates with the concave portion (13; 82; 91; 96; 102; 113) along a convex outer edge portion (10, 115) of its own, and is formed from a panel (6'; 6', 6"; 121*a*, 122*a*) having a first portion (6'*a*; 6'*a*, 6"*a*; 128) corresponding to the flat portion (8; 114), and a peripheral second portion defined by at least one curved strip (20; 20', 20"; 127) bounded internally by a curved crease line (19; 19', 19"; 126) extending along the convex outer edge portion (10; 115); the strip (20, 20', 20"; 127) being folded squarely, by drawing, to define a convex border (23; 129) extending along the convex outer edge portion (10; 115), and being made integral with an inner surface of the concave portion (13; 82; 91; 96; 102; 113).

31 Claims, 5 Drawing Sheets

RIGID CONTAINER FOR TOBACCO ITEMS AND METHOD OF PRODUCING SUCH A CONTAINER

CROSS-REFERENCE TO RELATED APPLICATION

This is the U.S. national phase application of International Application No. PCT/EP03/050075, filed 21 Mar. 2003, which claims the benefit of Italian patent application No. B02002A000138, filed Mar. 21, 2002.

TECHNICAL FIELD

The present invention relates to a rigid container for tobacco items.

More specifically, the present invention relates to a rigid container for tobacco'items, comprising at least one cup-shaped body having an end wall and a tubular lateral wall, a first of said walls comprising at least one inwardly concave portion, and a second of said walls comprising at least one flat portion having an outer edge comprising a convex portion flush with, and mating with, said concave portion.

To clarify the above statement, said flat wall may, for example, be defined by said end wall, which, in known manner, may be substantially rectangular with two opposite end portions, each of which is bounded externally by an outer edge, which may be defined by a half-oval line or by a compound line comprising a straight central portion and two opposite lateral portions, which may be curved and tangent to the straight central portion or straight or curved, but inclined with respect to the straight central portion. Alternatively, said end wall defines said concave wall, and the flat portion forms part of the tubular lateral wall.

BACKGROUND ART

In known rigid containers for tobacco items, e.g. containers for cigarettes and cigars, or containers for packets of cigarettes or cigars, said convex outer edge portion and relative said concave portion are not normally connected along the whole length, but only along part, of the convex portion, with the result that the containers are not only of relatively poor rigidity, but also fail to retain any tobacco powder detached from the tobacco items inside the containers.

DE3116924 discloses a cigarette carton with rounded ends and made from single flat blank with two flaps attached opposite sides of rectangle. The blank consists of a rectangular panel with a pair of flaps attached to the top and bottom edges; these have rounded ends (forming guiding edges top and bottom for the rounded ends of the carton. At each end are small projecting tabs top and bottom, and between the bottom two flaps are further tabs; these assist anchorage of the two bottom flaps after they have been folded over, and also for one top flap at one end, the other top flap can form a lid which can be swung open by itself.

U.S. Pat. No. 2,169,382 discloses a box made of pasteboard and having a heart-shaped contour; around the periphery of a heart-shaped blank of sheet material there is provided a pressed-up integral flange having folds therein at intervals compensating for excess material.

DISCLOSURE OF INVENTION

It is an object of the present invention to provide a rigid container for tobacco items, designed to eliminate the aforementioned drawbacks.

According to the present invention, there is provided a rigid container for tobacco items as recited by claim 1.

The present invention also relates to a method of producing a rigid container for tobacco items.

According to the present invention, there is provided a method of producing a rigid container for tobacco items as recited by claim 25.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
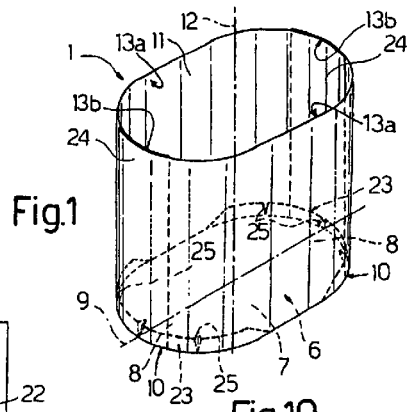
FIG. 1 shows a view in perspective of a preferred embodiment of the container according to the present invention.
Figures 5, 6, 7, 11, 12:
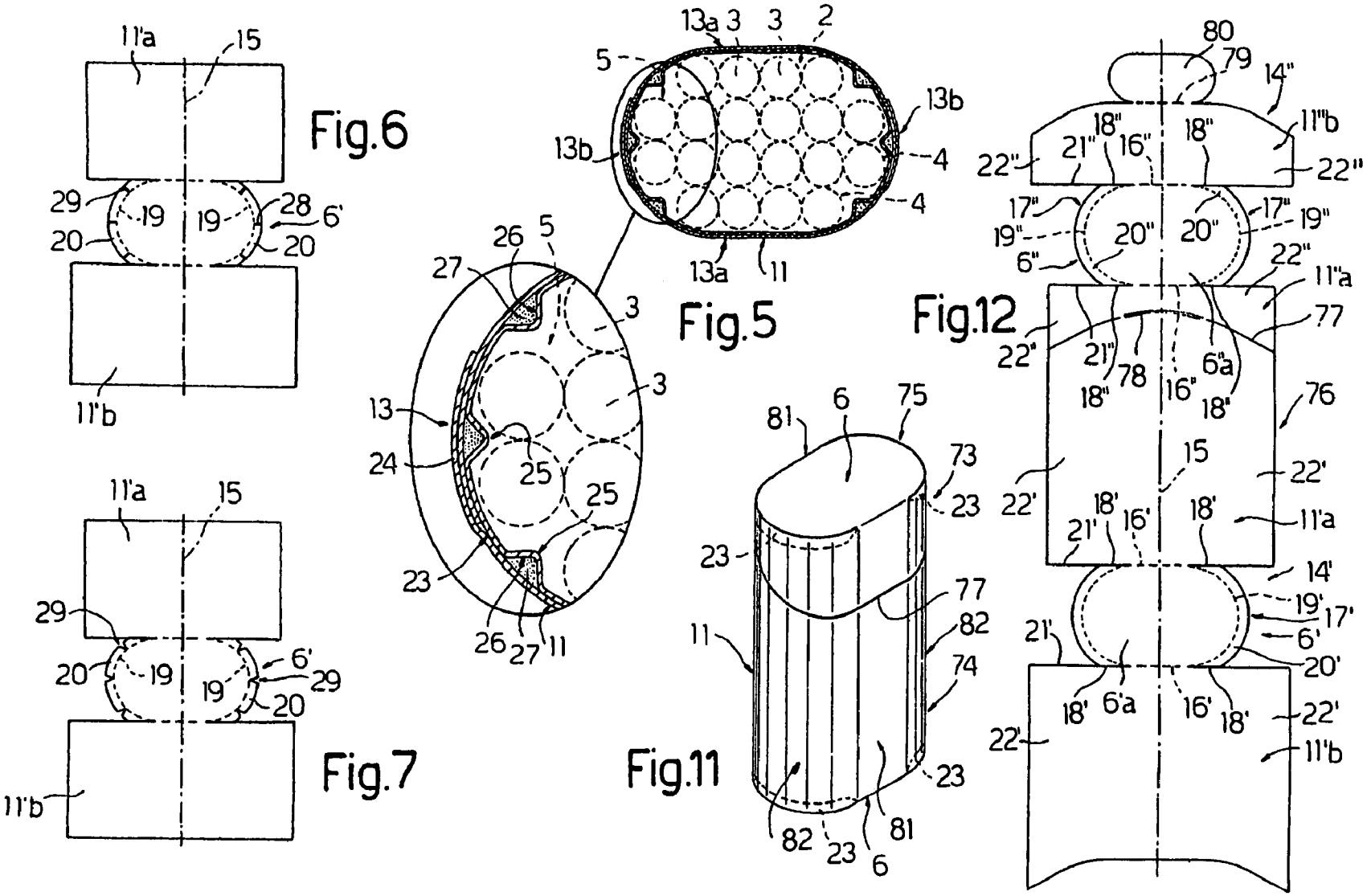
FIG. 5 shows a plan view of the FIG. 1 container with parts enlarged and in section.
FIG. 6 shows a first variation of the FIG. 2 blank.
FIG. 7 shows a second variation of the FIG. 2 blank.
FIG. 11 shows a view in perspective of a further preferred embodiment of the container according to the present invention.
FIG. 12 shows a plan view of a blank for producing the FIG. 11 container.

Number 1 in FIG. 1 indicates as a whole a container for tobacco items, which, in the example shown, are defined, as shown in FIG. 5, by a group 2 of twenty cigarettes 3 arranged in four layers 4, the end cigarettes 3 of each of which define, with the end cigarettes 3 of the other layers 4, two substantially curved end rows 5.

In variations not shown, container 1 may obviously be used for other tobacco items, such as cigars (not shown) or a number of containers (not shown) for cigars or cigarettes.

With reference to FIG. 1, container 1 is defined by a cup-shaped body comprising a flat, substantially oval end wall 6, in turn comprising a substantially rectangular central portion 7, and two end portions 8 aligned with each other and with central portion 7 along a major axis 9 and bounded externally by respective substantially oval, convex outer edges 10. Container 1 also comprises a tubular lateral wall 11, which extends along a longitudinal axis 12 perpendicular to end wall 6, is the same shape in section as end wall 6, and comprises two opposite, parallel, flat walls 13*a*, and two opposite concave portions 13*b*, each of which connects two corresponding edges of flat walls 13*a*, and has its concavity facing inwards so that each outer edge 10 is flush with, and mates with, the relative concave portion 13*b*.

Figure 3:
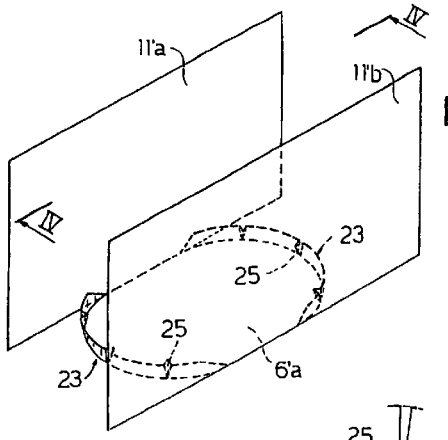
FIG. 3 shows a view in perspective of the FIG. 2 blank at a first folding step.
Figure 2:
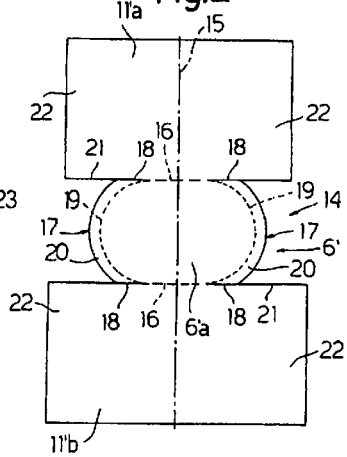
FIG. 2 shows a plan view of a blank for producing the FIG. 1 container.
Figure 4:
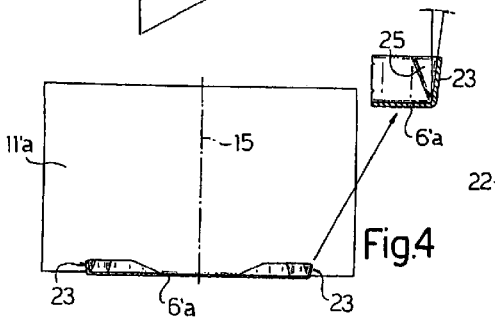
FIG. 4 shows a section along line IV-IV in FIG. 3.

As shown in FIGS. 2 to 4, container 1 is formed by folding a basic flat blank 14 comprising a central panel 6', and two panels 11'*a* and 11'*b*, which are aligned with central panel 6' along a longitudinal axis 15, and are each separated from central panel 6' by a respective straight crease line 16 crosswise to longitudinal axis 15. The ends in each pair of corresponding ends of crease lines 16 are connected by a respective curved edge 17, each end of which is defined by a straight cut 18 aligned with the respective crease line 16. Two curved crease lines 19 are formed on panel 6', each of which is tangent to both crease lines 16, and extends along a relative curved edge 17 to define, with curved edge 17, a strip 20 of substantially constant width normally ranging between 3 and 5 mm and preferably between 3 and 4 mm, and to define, with the other crease line 19 and the two crease lines 16, a central area 6'*a* of the same shape as end wall 6.

Each panel 11'*a*, 11'*b* is substantially rectangular and bounded, on the side facing central panel 6', by a respective straight edge 21 comprising a central portion defined by relative crease line 16; and two lateral portions, each of which projects outwards of relative curved edge 17, has an initial portion extending along a respective cut 18, is longer than half the length of relative curved crease line 19, and bounds, towards central panel 6', a respective lateral wing 22 of relative panel 11'*a*, 11'*b*.

As shown in FIGS. 3, 4 and 5, container 1 is formed from basic flat blank 14 in a succession of steps comprising a folding step, in which strips 20 are folded squarely with respect to central area 6'*a* to define end wall 6, which coincides with central area 6'*a*, and two convex borders 23, each extending along the whole of relative outer edge 10; a folding step, in which panels 11'*a*, 11'*b* are folded squarely with respect to central panel 6' and about respective crease lines 16; a folding step, in which wings 22 are folded so that wings 22 in each pair of corresponding wings 22 overlap along an overlap 24, with the inner surfaces of wings 22 contacting the outer surface of relative border 23; and a stabilizing step, in which, wings 22 are gummed in pairs to each other at overlap 24 and to relative borders 23.

More specifically, and as explained in detail later on, strips 20 are preferably folded by straightforward drawing, i.e. without weakening the material of basic blank 14 along curved crease lines 19, so that, after drawing, borders 23 slope slightly outwards, as opposed to being perfectly square with respect to central area 6'*a*, thus ensuring positive contact of borders 23 with the inner surfaces of wings 22 at the stabilizing step.

Since, as stated, borders 23 are formed by drawing, and strips 20 are continuous, square folding of strips 20 results (FIG. 5) in the formation, along each border 23, of a succession of tucks 25, each of which projects inwards, i.e. towards the concavity of relative border 23, and defines a relative groove 26 with its concavity facing outwards. At the stabilizing step referred to above, the gum interposed between each border and the inner surfaces of the respective pair of wings 22 flows into grooves 26 to firmly connect end wall 6 to lateral wall 11 of container 1, to ensure the end of container 1 is closed completely, with no gaps, and to define, when the gum is dry and between each border 23 and lateral wall 11, a succession of dried-gum ribs 27 for greatly strengthening the end of container 1.

As shown in FIG. 5 and explained in detail later on, both the formation and location of tucks 25 can be controlled so that each tuck 25 is located inside the gap between a respective pair of adjacent cigarettes 3 in the respective end row 5, so that cigarettes 3 are not only unaffected but also maintained substantially stationary with respect to container 1.

In the FIG. 6 variation, as opposed to being continuous, each strip 20 has a number of cuts 28 crosswise to relative curved crease line 19.

In this case, drawing results in the formation, at each cut 28, of a respective tuck (not shown) similar to tucks 25, or of a flat overlap (not shown).

Alternatively, as shown in FIG. 7, each cut 28 in FIG. 6 is replaced by a V-shaped slit 29 with its apex along relative curved crease line 19.

In this case, drawing results in the formation of a continuous border 23 with no tucks.

Figure 10:
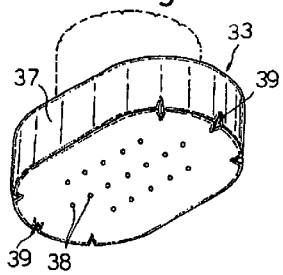
FIG. 10 shows a view in perspective of a detail in FIGS. 8 and 9.
Figure 8:
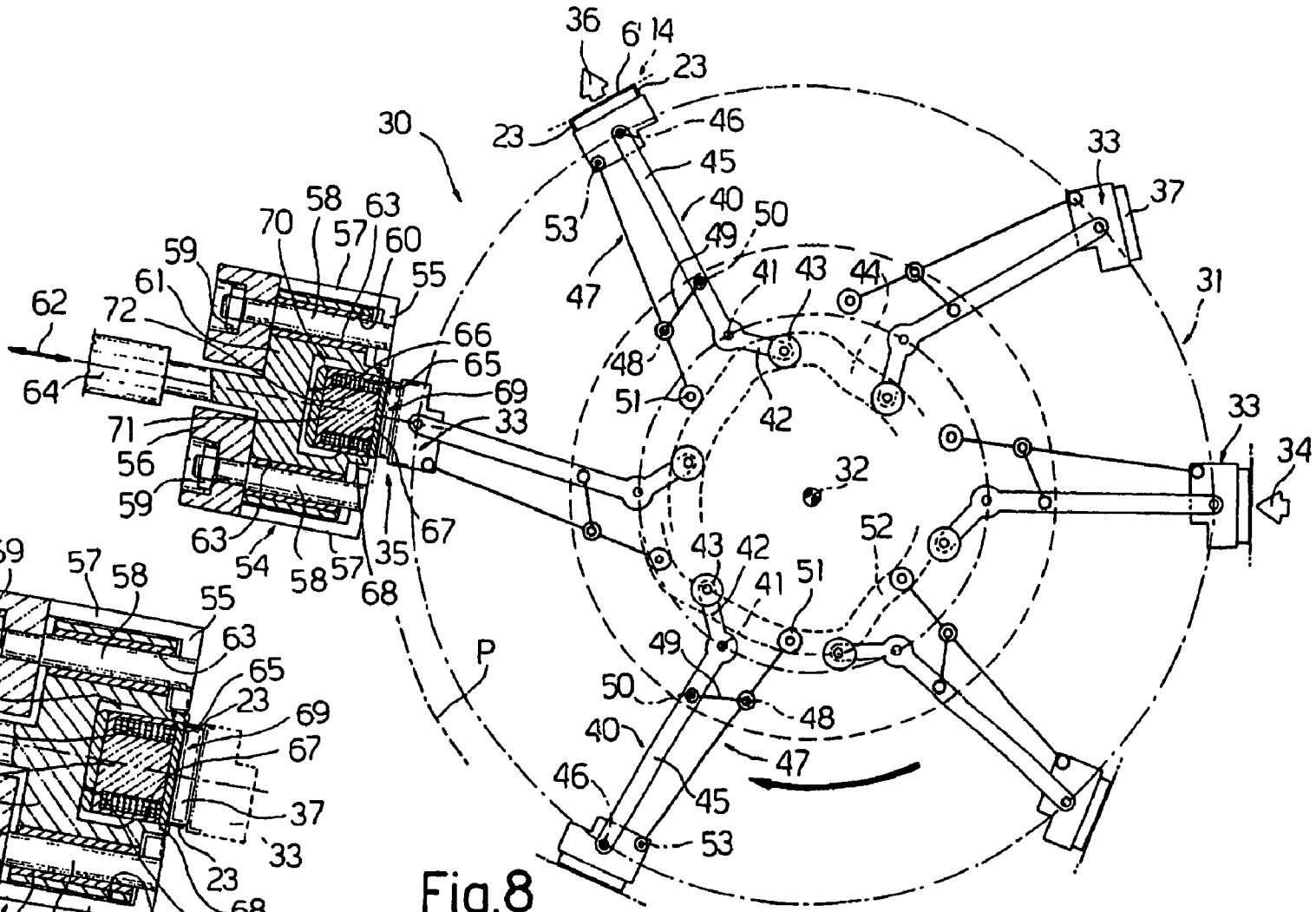
FIG. 8 shows a schematic side view of a device for conveying and folding the FIG. 2 blank.
Figure 9:
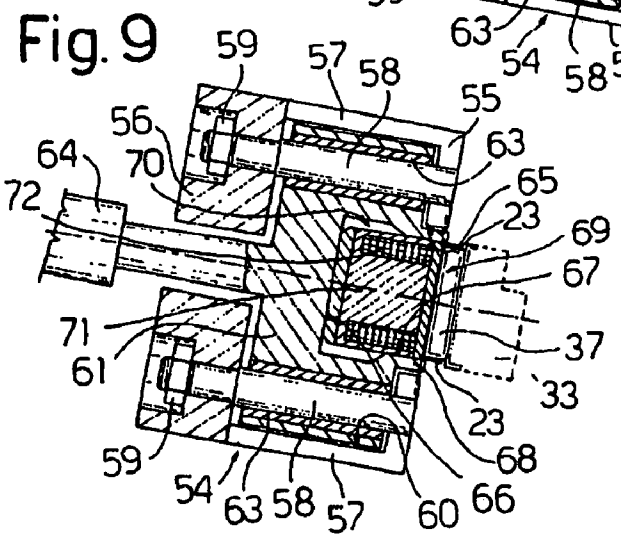
FIG. 9 shows a detail of FIG. 8 in a different operating position.

As shown in FIGS. 8 to 10, the drawing step is performed by conveying basic blank 14 on a conveying unit 30, which comprises a powered cylindrical conveying drum 31 rotating continuously anticlockwise, in FIG. 8, about a fixed axis 32 to feed a number of suction gripping heads 33—made at least partly of metal—along a substantially circular path P extending successively through a loading station 34, a drawing station 35, and an unloading station 36.

As shown in FIG. 10, each head 33 comprises a gripping wall 37 having a number of suction holes 38 and the same shape as end wall 6 of container 1, i.e. as central area 6'*a* of panel 6' of basic blank 14, and has, along its outer periphery, a number of grooves 39 arranged the same way as tucks 25.

As shown in FIG. 8, each head 33 is connected to drum 31 by a respective rocker arm 40, which is hinged to drum 31 to oscillate about a respective axis 41 parallel to axis 32, and comprises an arm 42 extending towards axis 32 and fitted on its free end with a tappet roller 43 cooperating with a fixed cam 44 to control the angular position of relative rocker arm 40 about relative axis 41. Each rocker arm 40 also comprises a further arm 45, which extends outwards with respect to drum 31, and the free end of which is hinged to respective head 33, which is free to oscillate, with respect to relative arm 45, about an axis 46 parallel to axis 32.

The angular position of each head 33 with respect to relative arm 45 and about relative axis 46 is controlled by a respective further rocker arm 47, which is hinged to rotate about a respective axis 48 parallel to axis 32, and moves with the end of a respective connecting rod 49 hinged to an intermediate point of relative arm 45 to oscillate about a respective axis 50 parallel to axis 32. Each rocker arm 47 is fitted on its inner end with a tappet roller 51 cooperating with a cam 52 extending, like cam 44, about axis 32, and is connected at its outer end to relative head 33 by a hinge 53, the axis of which is parallel to axis 32 and located a given distance from relative axis 46.

As shown in FIGS. 8 and 9, drawing station 35 is located in an intermediate position between loading station 34 and unloading station 36, and comprises a fixed, prismatic box body 54 having a front wall 55 tangent to path P, a rear wall 56 parallel to front wall 55, and two lateral walls 57 perpendicular to front wall 55 and rear wall 56. Rear wall 56 is connected removably to front wall 55 by two threaded pins 58, extending parallel to lateral walls 57 from front wall 55 and through rear wall 56, and by two nuts 59, so as to close an inner chamber 60 of box body 54. Chamber 60 houses a hollow punch 61, which, by means of an actuator 64, slides along chamber 60 and through a hole 65, formed in front wall 55, in a direction 62 radial with respect to path P and parallel to threaded pins 58, to which hollow punch 61 is fitted by means of sliding bearings 63. At the front, hollow punch 61 has a central cavity 66 communicating externally through an opening 67, which is roughly the same shape as and slightly larger than gripping walls 37 of heads 33, and is surrounded by a border, which moves with hollow punch 61 through hole 65 and is defined by two opposite segments 68 arranged the same way as the two strips 20. Central cavity 66 houses an electromagnetic gripper 69 defined by a prismatic block 70 mounted to slide a given limited distance in direction 62 and through opening 67, and having a central core 71 supporting an electric winding 72 connectable to a current source (not shown) and having an axis parallel to direction 62.

In actual use, and with reference to FIGS. 8 and 9, basic blanks 14 are fed successively to loading station 34, where each basic blank 14 is positioned with the inner surface of central area 6'*a* of relative panel 6' contacting gripping wall 37 of a relative head 33.

In a known variation not shown, loading station 34 is defined by an open end wall of a container containing a stack of basic blanks 14, each of which is withdrawn by a respective head 33 through the open end wall.

Each basic blank 14 is then fed along path P by relative head 33, which, by means of cams 44 and 52, first accelerates in known manner with respect to drum 31, and, on reaching drawing station 35, decelerates so as to remain stationary for a given length of time at drawing station 35, with gripping wall 37 tangent to path P.

When head 33 reaches drawing station 35, hollow punch 61 is in a withdrawn rest position of non-interference with head 33 and relative basic blank 14, and no current flows in electric winding 72. As soon as prismatic block 70 contacts the outer surface of central area 6'*a* of central panel 6', electromagnetic gripper 69 is activated to feed current through electric winding 72 and so generate a magnetic field which links with head 33, so that prismatic block 70 adheres to head 33 to clamp central panel 6' to head 33. Once the panel is clamped, hollow punch 61 is moved by actuator 64 into a forward work position (FIG. 9), in which border segments 68 are engaged by head 33 to draw strips 20 and so form relative borders 23.

At this point, electric winding 72 is deactivated, hollow punch 61 is restored to the withdrawn rest position, and head 33 is again accelerated to move from drawing station 35 to unloading station 36, where relative basic blank 14 is transferred to a follow-up drum (not shown). Panels 11'*a* and 11'*b* are normally folded squarely (FIG. 3) in known manner during transfer from drum 31 to said follow-up drum (not shown), on which container 1 is completed by gumming borders 23 and lateral wings 22, and folding lateral wings 22 in pairs onto each other and onto relative borders 23.

Since each border 23 extends along the whole of relative crease line 19, end wall 6 is connected to lateral wall 11 along the whole of its perimeter, thus eliminating any gaps through which tobacco powder may escape.

When drawing strips 20, grooves 39 cooperate with strips 20 to guide the formation of tucks 25. If strips 20 with cuts 28 (FIG. 6) are used, grooves 39 form tucks (not shown) similar to tucks 25. Conversely, if no grooves 39 are provided, the opposite portions of each cut 28 overlap to define a respective rib (not shown) for strengthening relative border 23.

If strips 20 with slits 29 are used, grooves 39 may be dispensed with.

FIGS. 11 and 12 show a hinged-lid, substantially oval-section packet 73 comprising a body 74 and a lid 75, each of which is defined by a relative container similar to container 1 and positioned with its concavity facing that of the other container.

Packet 73 comprises a tubular lateral wall 11 and two opposite end walls 6, and is formed by folding a blank 76 (FIG. 12) defined by two basic blanks 14' and 14" for forming body 74 and lid 75 respectively. The component parts of basic blanks 14' and 14" are indicated using the same reference numbers as for basic blank 14, but with a (') and (") respectively.

Panels 11'*a* and 11"*a* of basic blanks 14' and 14" are adjacent to each other along a curved cut line 77, an intermediate portion of which is not cut and is defined by a hinge crease line 78 connecting lid 75 to body 74.

Panel 11"*b* of basic blank 14" is connected, along a crease line 79 opposite and parallel to relative crease line 16", to a reinforcing panel 80, which is folded in known manner onto the inner surface of panel 11"*b* to reinforce the front of lid 75.

Given the shape of curved edges 17', 17" and crease lines 19', 19", lateral wall 11 of packet 73 comprises two opposite parallel flat portions 81 connected to each other by two inwardly concave portions 82, each of which is integral, at opposite ends, with relative borders 23.

When forming packet 73, panels 6' and 6" are drawn by respective heads 33, which may be integral with each other and activated by the same drum 31, or may be carried by different drums 31 arranged in series.

Figures 13, 14, 15, 17, 19:
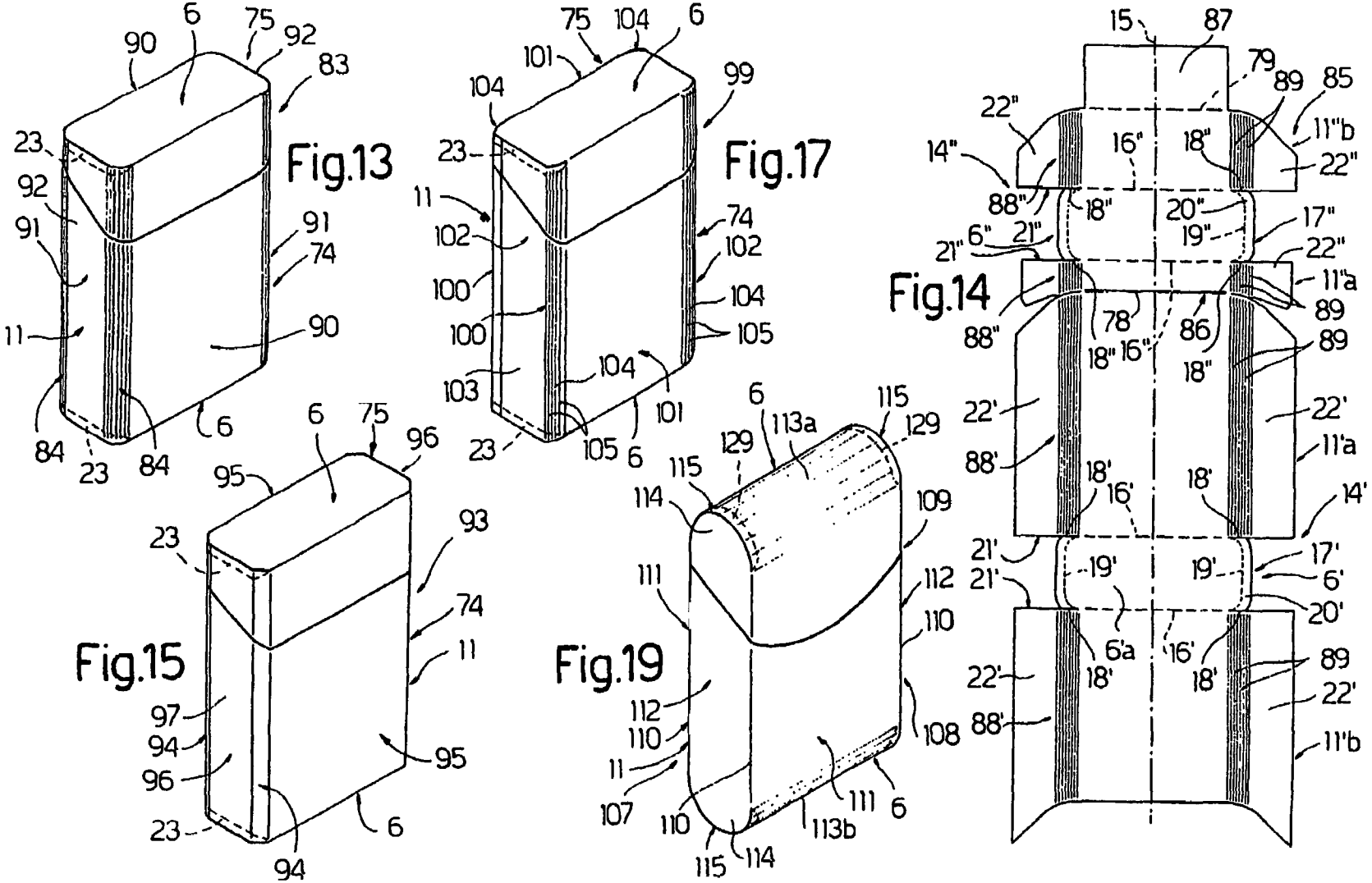
FIG. 13 shows a view in perspective of a further preferred embodiment of the container according to the present invention.
FIG. 14 shows a plan view of a blank for producing the FIG. 13 container.
FIG. 15 shows a view in perspective of a further preferred embodiment of the container according to the present invention.
FIG. 17 shows a view in perspective of a further preferred embodiment of the container according to the present invention.
FIG. 19 shows a view in perspective of a further preferred embodiment of the container according to the present invention.

FIGS. 13 and 14 show a hinged-lid packet 83 with rounded longitudinal edges 84, which also comprises a tubular lateral wall 11 and two opposite end walls 6, and is defined by a body 74 and a lid 75, each defined by a relative container similar to container 1 and positioned with its concavity facing that of the other container.

Packet 83, which is similar in concept to packet 73, is formed by folding a blank 85 (FIG. 14) defined by two basic blanks 14' and 14" for forming body 74 and lid 75 respectively. The component parts of basic blanks 14' and 14" are indicated using the same reference numbers as for basic blank 14, but with a (') and (") respectively.

Panels 11'*a* and 11"*a* of basic blanks 14' and 14" of blank 85 are adjacent to each other along a curved cut line 86, an intermediate portion of which is defined by a straight hinge crease line 78 connecting lid 75 to body 74.

Panel 11"*b* of basic blank 14" of blank 85 is connected, along a crease line 79 opposite and parallel to relative crease line 16", to a reinforcing panel 87, which, like panel 80 of packet 73, is folded in known manner onto the inner surface of panel 11"*b* to reinforce the front of lid 75.

The central portion of each panel 11'*a*, 11'*b*, 11"*a*, 11"*b* of blank 85 is separated from relative wings 22', 22" by respective strips 88', 88", each having a number of longitudinal crease lines 89 for forming rounded longitudinal edges 84 in known manner. And each curved edge 17', 17" and each curved crease line 19', 19" of each panel 6', 6" have a straight intermediate portion, and two curved end portions in the form of a 90° arc of a circle and tangent to a relative straight edge 21', 21".

Given the shape of curved edges 17', 17" and crease lines 19', 19", lateral wall 11 of packet 83 comprises two opposite parallel flat portions 90 connected to each other by two inwardly concave portions 91. Each concave portion 91 is integral, at opposite ends, with relative borders 23, and in turn comprises a flat intermediate wall 92, and two curved outer strips, which define respective curved longitudinal edges 84, are located on opposite sides of relative flat intermediate wall 92, and in section are in the form of respective roughly 90° arcs of a circle tangent to relative flat intermediate wall 92.

Figures 16, 18, 20:
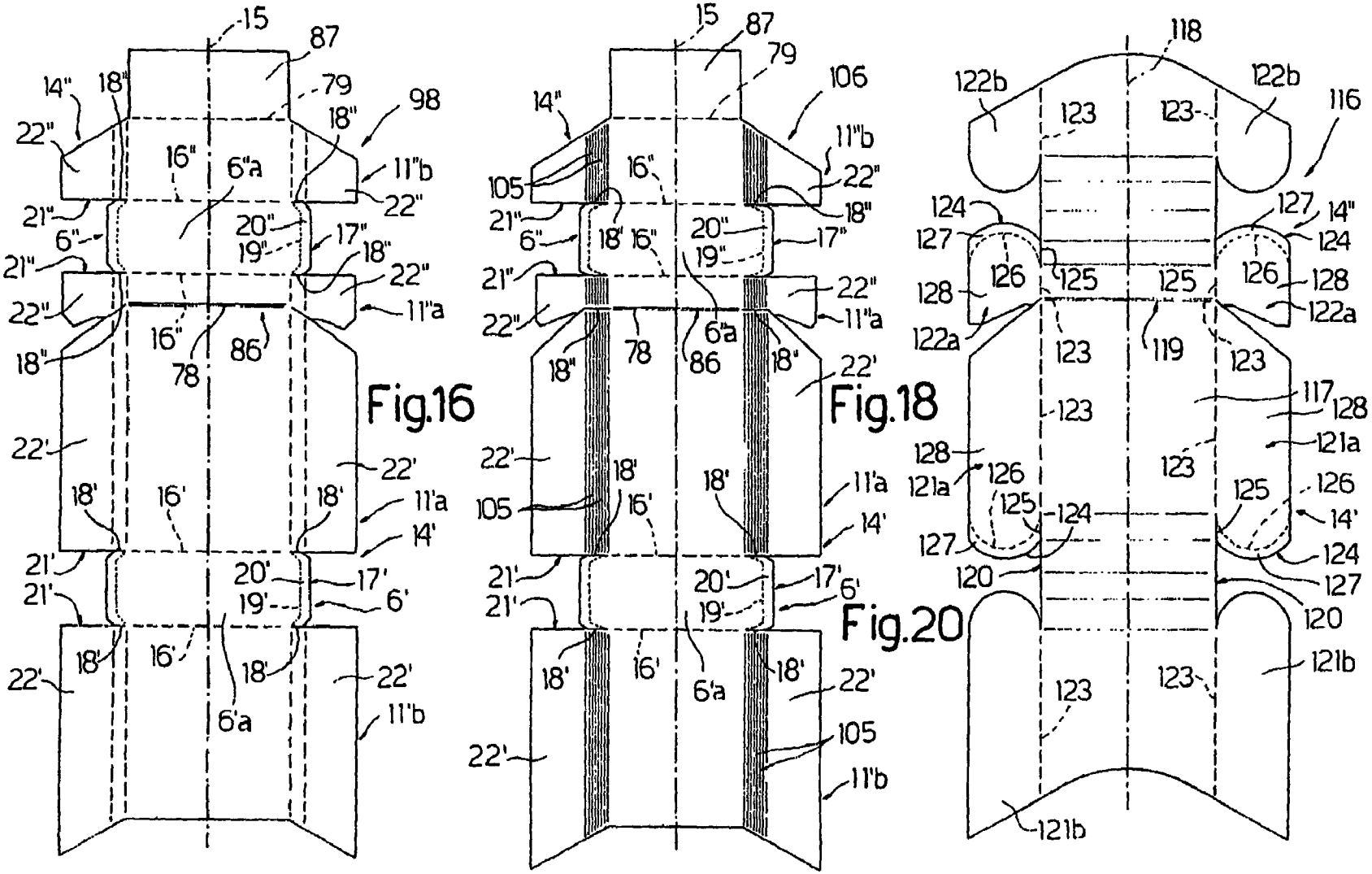
FIG. 16 shows a plan view of a blank for producing the FIG. 15 container.
FIG. 18 shows a plan view of a blank for producing the FIG. 17 container.
FIG. 20 shows a plan view of a blank for producing the FIG. 19 container.

FIGS. 15 and 16 show a packet 93, which is similar in concept to packet 83, comprises a tubular lateral wall 11 and two opposite end walls 6, and is defined by a body 74 and a lid 75 hinged to each other. Packet 93 has 45° beveled longitudinal edges 94, and lateral wall 11 comprises two opposite parallel flat portions 95 connected to each other by two inwardly concave portions 96. Each concave portion 96 is integral, at opposite ends, with relative borders 23, and comprises a flat intermediate wall 97, and two flat outer strips at 45° to relative flat intermediate wall 97 and defining respective beveled longitudinal edges 94. To enable each concave portion 96 to cooperate with relative borders 23, packet 93 is formed from a blank 98 similar to blank 85, and in which each curved edge 17', 17" and each curved crease line 19', 19" of each panel 6', 6" comprise a straight intermediate portion, and two straight end portions at 45° to both the relative straight intermediate portion and the relative straight edge 21', 21".

FIGS. 17 and 18 show a packet 99, which is similar in concept to packet 83, comprises a tubular lateral wall 11 and two opposite end walls 6, and is defined by a body 74 and a lid 75 hinged to each other. Packet 99 has sharp longitudinal edges 100, and lateral wall 11 comprises two opposite parallel flat portions 101 connected to each other by two inwardly concave portions 102. Each concave portion 102 is integral, at opposite ends, with relative borders 23, and in turn comprises a flat intermediate wall 103 bounded laterally by two respective longitudinal edges 100; and two inclined outer strips 104, which are located on opposite sides of relative flat intermediate wall 103, are connected to flat intermediate wall 103 along respective longitudinal edges 100, have a number of longitudinal crease lines 105, and are each in section substantially in the form of an arc of a circle tangent to a respective flat portion 101. To enable each concave portion 102 to cooperate with relative borders 23, packet 99 is formed from a blank 106 similar to blank 98, and in which each curved edge 17', 17" and each curved crease line 19', 19" of each panel 6', 6" comprise a straight intermediate portion, and two curved inclined end portions, each of which is in the form of an arc of a circle tangent to the relative straight edge 21', 21" and forming a sharp angle with said straight intermediate portion.

FIGS. 19 and 20 show a hinged-lid, substantially rectangular-section packet 107, which comprises two cup-shaped containers hinged to each other, positioned with their respective concavities facing each other, and defining a body 108 and a lid 109. Packet 107 has four sharp longitudinal edges 110; and a lateral wall 11 comprising two opposite parallel flat major lateral walls 111, and two opposite parallel flat minor lateral walls 112, each of which is connected to the two flat major lateral walls 111 along two longitudinal edges 110. The flat major lateral walls 111 are connected to each other at the top and bottom by two inwardly concave portions 113, each of which defines a relative end wall 6 of packet 107, and, though substantially semicircular in section in the example shown, may also have a differently shaped section. The two concave portions, indicated 113*a* and 113*b*, are inwardly concave, and define a top wall of lid 109 and a bottom wall of body 108 respectively; and each of the two minor lateral walls 112 comprises a substantially rectangular central portion extending between two longitudinal edges 110, and two end portions 114, each of which is bounded externally by a respective convex edge 115, which, in the example shown, is semicircular and is flush with, and mates with, the relative concave portion 113.

Packet 107 is formed from a blank 116, as shown in FIG. 20, comprising a substantially rectangular central strip 117, which, when folded, defines flat major lateral walls 111 and the two concave portions 113, has a longitudinal axis 118, and is crossed by a crease line 119, which extends crosswise to longitudinal axis 118, defines a hinge connecting lid 109 and body 108, and divides blank 116 into two conceptually similar basic blanks 14' and 14".

Central strip 117 is bounded laterally by two edges 120 parallel to each other and to longitudinal axis 118, and from each of which project outwards two pairs of wings or panels indicated 121*a*, 121*b*, 122*a*, 122*b*, and connected to central strip 117 at respective crease lines 123 extending along relative edge 120. Panels 121*a* and 122*a* are located adjacent to each other on opposite sides of crease line 119, and each is bounded, on the side facing relative panel 121*b*, 122*b*, by a respective curved edge 124, one end of which is defined by a straight cut 125 extending along relative edge 120. A curved crease line 126 is formed on each panel 121*a*, 122*a*, and extends along relative curved edge 124 to define, with and on the same side as curved edge 124, a strip 127 of substantially constant width normally ranging between 3 and 5 mm and preferably between 3 and 4 mm, and to define, on the opposite side to curved edge 124, an elongated area 128 of substantially the same shape as relative panel 121*b*, 122*b*.

In actual use, strips 127 are folded substantially squarely by drawing to form four curved borders 129 (FIG. 19) which are gummed; panels 121*a* and 122*a* are folded squarely with respect to strip 117, which is then wrapped about borders 129 to form flat major lateral walls 111 and the two concave portions 113; and, finally, panels 121*b* and 122*b* are folded and gummed to relative panels 121*a* and 122*a* to complete flat minor lateral walls 112.

As stated, concave portions 113 of packet 107 described above are substantially semicircular in section, and end portions 114 of flat minor lateral walls 112 are complementary in shape to concave portions 113. In variations not shown, however, concave portions 113 and end portions 114 may obviously be of variously rounded and/or beveled sections and shapes respectively.

In the above description, all the containers and/or packets are formed from longitudinal blanks, i.e. blanks in which all the panels, including the drawn panels, are arranged along a longitudinal axis. Obviously, if transverse blanks are used, in which all but the drawn panels are arranged along a transverse axis, and the drawn panels, of whatever shape, project from the top and/or bottom of the other panels, the drawn borders are normally C-shaped borders extending along the whole free edge of the drawn panels.

It should be pointed out that strips 20', 20" and 127 may comprise cuts 28 or V-shaped slits 29 as shown in FIGS. 6 and 7 respectively.

The invention claimed is:

1. A rigid container for tobacco items defined by a hinged-lid packet (73; 83; 93; 99; 107) comprising two cup-shaped bodies aligned with each other with their concavities facing, and respectively defining a lid (75; 109) and a body (74; 108) of the packet (73; 83; 93; 99; 107);

each cup-shaped body having an end wall (6) and a tubular lateral wall (11), a first of said end wall or tubular lateral wall (6, 11) comprising at least one inwardly concave portion (13; 82; 91; 96; 102; 113), and a second of said end wall or tubular lateral wall (6, 11) comprising at least one flat portion (8; 114) having an outer edge comprising a convex portion (10; 115) flush with, and mating with, said concave portion (13; 82; 91; 96; 102; 113);

said packet (73; 83; 93; 99; 107) being formed by folding a single flat substantially rectangular blank (76; 85; 98; 106; 116) having a longitudinal axis (15; 118) and comprising two intermediate panels (6', 6"; 121*a*, 122*a*), each of which forms one of said flat portions (8; 114), and a first and a second outer panel (22; 22', 22"), which are located on opposite sides of one said intermediate panel (6', 6"; 121*a*, 122*a* ) and are aligned with each other and with said intermediate panel (6', 6"; 121*a*, 122*a*) along the longitudinal axis (15);

each intermediate panel (6'; 6', 6"; 121*a*, 122*a*) having a first portion (6'*a*; 6'*a*, 6"*a*; 128) corresponding to said flat portion (8; 114), and a second portion, peripheral with respect to said first portion (6'*a*; 6'*a*, 6"*a*; 128), defined by at least one curved strip (20; 20', 20"; 127) bounded internally by a curved crease line (19; 19', 19"; 126) extending along said convex outer edge portion (10; 115); and said curved strip (20; 20', 20"; 127) being folded substantially squarely to define, on the second of said end wall or tubular lateral wall (6, 11), a convex border (23; 129) integral with the second of end wall or tubular lateral wall walls (6, 11), extending along said convex outer edge portion (10; 115), and made integral with an inner surface of said concave portion (13; 82; 91; 96; 102; 113).

2. A container as claimed in claim 1, wherein said curved strip (20; 20', 20"; 127) is of substantially constant width.

3. A container as claimed in claim 1, wherein said curved strip (20; 20', 20"; 127) is 3 to 5 mm in width.

4. A container as claimed in claim 1, wherein said curved strip (20; 20', 20"; 127) is 3 to 4 mm in width.

5. A container as claimed in claim 1, wherein said curved strip (20; 20', 20"; 127) is folded by drawing.

6. A container as claimed in claim 1, wherein said curved strip (20; 20', 20"; 127) is folded by drawing between an anvil (33) and a punch (61).

7. A container as claimed in claim 6, wherein said anvil (33) is a suction head (33) for supporting and moving said flat blank (14; 76; 85; 98; 106; 116); and said suction head (33) is positioned, in use, contacting an inner surface of each said intermediate panel (6', 6"; 121*a*, 122*a*).

8. A container as claimed in claim 1, wherein said curved strip (20; 20', 20"; 127) and the relative convex border (23; 129) are continuous.

9. A container as claimed in claim 8, wherein said convex border (23; 129) has tucks (25) defining relative longitudinal grooves (26) extending in a direction substantially perpendicular to each said intermediate panel (6', 6"; 121*a*, 122*a*).

10. A container as claimed in claim 9, wherein each of said tucks (25) projects from the relative said convex border (23; 129) towards a concavity of the convex border (23; 129), and the relative said longitudinal groove (26) is positioned with its concavity facing outwards.

11. A container as claimed in claim 10, wherein said convex border (23; 129) is made integral with said inner surface of said concave portion (13; 82; 91; 96; 102; 113) by gumming, and has a number of outer longitudinal reinforcing ribs (27) defined by dried gum inside said longitudinal grooves (26).

12. A container as claimed in claim 1, wherein said curved strip (20; 20', 20"; 127) has a number of transverse cuts (28).

13. A container as claimed in claim 1, wherein said curved strip (20; 20', 20"; 127) has a number of triangular slits (29) with their apexes on said curved crease line (19; 19', 19"; 126).

14. A container as claimed in claim 1, wherein the first of said end wall or tubular lateral wall (6, 11) is said tubular lateral wall (11).

15. A container as claimed in claim 14, wherein the first of said end wall or tubular lateral wall (6, 11) comprises two opposite parallel flat portions (81; 90; 95; 101) connected to each other by two said concave portions (82; 91; 96; 102).

16. A container as claimed in claim 15, wherein said concave portion (96) comprises a flat intermediate wall (97); and two inclined flat outer strips (94) located on opposite sides of said flat intermediate wall (97) and forming substantially 45° angles with said flat intermediate wall (97).

17. A container as claimed in claim 15, wherein said concave portion (91) comprises a flat intermediate wall (92); and two curved outer strips (84) located on opposite sides of said flat intermediate wall (92), and which, in section, are in the form of respective roughly 90° arcs of a circle tangent to said flat intermediate wall (92).

18. A container as claimed in claim 15, wherein said concave portion (102) comprises a flat intermediate wall (103); and two inclined outer strips (104) located on opposite sides of said flat intermediate wall (103) and connected to said flat intermediate wall (103) along respective sharp edges (100); each inclined outer strip (104) being in section substantially in the form of an arc of a circle tangent to a respective said flat portion (101) of said first wall (11).

19. A container as claimed in claim 15, wherein said concave portion (82) comprises a curved surface substantially, in section, in the form of an arc of an ellipse.

20. A container as claimed in claim 1, wherein each said intermediate panel (6', 6") has an outer edge comprising two straight portions (16; 16', 16") crosswise to said longitudinal axis (15), and two convex portions (17; 17', 17") located on opposite sides of said longitudinal axis (15), and each of which connects corresponding ends of said two straight portions (16; 16', 16"), extends along a respective said crease line (19; 19', 19"), and defines an outer edge for a relative said curved strip (20; 20', 20").

21. A container as claimed in claim 20, wherein each said curved strip (20; 20', 20") has two ends, each of which defines a respective end portion of a respective said straight portion (16; 16', 16") and is separated from the respective said intermediate panel (6', 6") by a respective cut (18).

22. A container as claimed in claim 1, wherein the first of said end wall or tubular lateral wall (6, 11) is a said end wall (6).

23. A container as claimed in claim 22, wherein the second of said end wall or tubular lateral wall (6, 11) comprises two opposite parallel flat walls (112), each of which is bounded, towards the first of said end wall or tubular lateral wall (6, 11) by a respective said convex outer edge portion (115), which is complementary in shape to that of the first of said end wall or tubular lateral wall (6, 11).

24. A container as claimed in claim 1, wherein each said intermediate panel (6', 6"; 121*a*, 122*a*) is connected to at least one further panel (11'*a*, 11'*b*; 11'*a*, 11'*b*, 11"*a*, 11"*b*; 117) along a straight crease line (16'; 16', 16"; 123); said further panel (11'*a*, 11'*b*; 11'*a*, 11'*b*, 11"*a*, 11"*b*; 117) being bounded, on the side facing said intermediate panel (6', 6"; 121*a*, 122*a*), by a straight edge (21; 21', 21"; 120) comprising said crease line (16'; 16', 16"; 123).

25. A method of producing a rigid container for tobacco items defined by a hinged-lid packet (73; 83; 93; 99; 107) comprising two cup-shaped bodies aligned with each other with their concavities facing, and respectively defining a lid (75; 109) and a body (74; 108) of the packet (73; 83; 93; 99; 107);

each cup-shaped body having an end wall (6) and a tubular lateral wall (11), a first of said end wall or tubular lateral wall (6, 11) comprising at least one inwardly concave portion (13; 82; 91; 96; 102; 113), and a second of said end wall or tubular lateral wall (6, 11) comprising at least one flat portion (8; 114) having an outer edge comprising a convex portion (10; 115) flush with, and mating with, said concave portion (13; 82; 91; 96; 102; 113);

said packet (73; 83; 93; 99; 107) being formed by folding a single flat substantially rectangular blank (76; 85; 98; 106; 116) having a longitudinal axis (15; 118) and comprising two intermediate panels (6', 6"; 121*a*, 122*a*), each of which forms one of said flat portions (8; 114), and a first and a second outer panel (22; 22', 22"), which are located on opposite sides of one said intermediate panel (6', 6"; 121*a*, 122*a*) and are aligned with each other and with said intermediate panel (6', 6"; 121*a*, 122*a*) along the longitudinal axis (15);

the method comprising a feed step for feeding, along a given path (P), each intermediate panel (6'; 6', 6"; 121*a*, 122*a*) having a first portion (6'*a*; 6'*a*, 6"*a*; 128) corresponding to said flat portion (8; 114), and a second portion, peripheral with respect to said first portion (6'*a*; 6'*a*, 6"*a*; 128), defined by at least one curved strip (20; 20', 20"; 127) bounded internally by a curved crease line (19; 19', 19"; 126) extending along said convex outer edge portion (10; 115);

a first folding step wherein said curved strip (20; 20', 20"; 127) is folded substantially squarely, at a work station (35) located along said path (P), to define a curved convex border (23; 129) integral with said convex outer edge portion (10; 115); and a connecting step wherein said curved convex border (23; 129) is made integral with an inner surface of said concave portion (13; 82; 91; 96; 102; 113).

26. A method as claimed in claim 25, comprising a further folding step, wherein said flat blank (14; 76; 85; 98; 106; 116) is folded so that said convex outer edge portion (10; 115) is flush with, and mates with, said concave portion (13; 82; 91; 96; 102; 113), and said convex border (23; 129) contacts said inner surface of said concave portion (13; 82; 91; 96; 102; 113).

27. A method as claimed in claim 25, wherein said first folding step is a drawing step, and said work station (35) is a drawing station.

28. A method as claimed in claim 27, wherein said drawing step is performed by positioning each said intermediate panel (6', 6"; 121 *a*, 122*a*) with the relative said first portion (6'*a*; 6'*a*, 6"*a*; 128) between an anvil (33) and a punch (61), and by imparting a relative penetration movement to said anvil (33) and said punch (61).

29. A method as claimed in claim 28, wherein said anvil (33) is a suction head (33) for supporting and moving said blank (14; 76; 85; 98; 106; 116), and said suction head (33) is positioned, in use, contacting an inner surface of said panel (6'; 6', 6"; 121*a*, 122*a*).

30. A method as claimed in claim 28, and comprising a gripping step, which precedes said penetration movement and provides for gripping said panel (6'; 6', 6"; 121*a*, 122*a*) to said anvil (33).

31. A method as claimed in claim 30, wherein said gripping step is performed by electromagnetic means (69) carried by said punch (61) and linked magnetically to said anvil (33).

* * * * *

UNITED STATES PATENT AND TRADEMARK OFFICE

CERTIFICATE OF CORRECTION

PATENT NO. : 7,318,523 B2
APPLICATION NO. : 10/508725
DATED : January 15, 2008
INVENTOR(S) : Mario Spatafora It is certified that error appears in the above-identified patent and that said Letters Patent is hereby corrected as shown below:

At Column 9, line 38, “wall walls” should be -- wall --.

Signed and Sealed this

Eighth Day of July, 2008

JON W. DUDAS
*Director of the United States Patent and Trademark Office*